United States Patent [19]

Sakamaki et al.

[11] Patent Number: 4,620,837

[45] Date of Patent: Nov. 4, 1986

[54] VANE-TYPE ROTARY COMPRESSOR HAVING A SLEEVE FOR ROTATION WITH VANES

[75] Inventors: Hiroshi Sakamaki, Utsunomiya; Yukio Horikoshi, Kazo; Kikuji Yanagihashi, Yono, all of Japan

[73] Assignee: Nippon Piston Ring Co., Ltd., Tokyo, Japan

[21] Appl. No.: 668,268

[22] PCT Filed: Feb. 22, 1984

[86] PCT No.: PCT/JP84/00060

§ 371 Date: Oct. 17, 1984

§ 102(e) Date: Oct. 17, 1984

[87] PCT Pub. No.: WO84/03334

PCT Pub. Date: Aug. 30, 1984

[30] Foreign Application Priority Data

| | | | |
|---|---|---|---|
| Feb. 23, 1983 | [JP] | Japan | 58-047258 |
| Feb. 24, 1983 | [JP] | Japan | 58-028608 |
| Mar. 23, 1983 | [JP] | Japan | 58-047257 |
| May 20, 1983 | [JP] | Japan | 58-087732 |

[51] Int. Cl.[4] ..... F04C 18/348

[52] U.S. Cl. ..... 418/173

[58] Field of Search ..... 418/173, 71; 384/109, 384/114, 107, 112, 118

[56] References Cited

U.S. PATENT DOCUMENTS

| | | | |
|---|---|---|---|
| 2,918,877 | 12/1959 | Woodcock | 418/71 |
| 3,167,362 | 1/1965 | Dschen | 384/118 |
| 4,479,763 | 10/1984 | Sakamaki et al. | 418/173 X |
| 4,514,156 | 4/1985 | Sakamaki et al. | 418/173 |

*Primary Examiner*—Leonard E. Smith

*Attorney, Agent, or Firm*—Birch, Stewart, Kolasch & Birch

[57] ABSTRACT

A vane-type rotary compressor has a rotary sleeve (30) mounted in a center housing (22) for rotation with a plurality of vanes (16) movable in a rotor (10). The rotary sleeve is floatingly supported in an air-bearing room (40) defined between the outer periphery of the center housing. The air-bearing room has a supply of air through an inlet port (71) internally connected to a discharge chamber (41) or a compression working space (43) under the maximum pressure. At least a pocket (73, 74) is provided in the inner periphery of the center housing to increase the bearing performance of the air-bearing room and protect the rotary sleeve and the center housing against scuffing and seizure troubles therebetween.

9 Claims, 14 Drawing Figures

VANE-TYPE ROTARY COMPRESSOR HAVING A SLEEVE FOR ROTATION WITH VANES

TECHNICAL FIELD

The present invention relates to improvements in a vane-type rotary compressor provided with a rotary sleeve which is rotatable together with a plurality of vanes between a center housing and a rotor.

BACKGROUND ART

There is disclosed a vane-type rotary compressor provided with a rotary sleeve which is interposed between a center housing and a rotor and supported by compressible fluid for rotation with a plurality of vanes by Tokkyo Kokai Koho (Japanese Published Unexamined Patent Application) Sho 58-65988. The compressor is particularly suitable for use with an automobile engine required to operate over a wide speed range because of being substantially free from frictional heat as well as wear at the apex of each vane. However, there is the possibility of scuffing and seizure troubles if air is highly compressed in the compression working space within the compressor to push the rotary sleeve from within to the inner periphery of the center housing. From a study on the movement of the rotary sleeve, it has been clarified with the rotary sleeve has its center moved along not a straight line but an ellipitical figure to contact the compression side inner periphery of the center housing and that the outer periphery of the rotary sleeve touches the inner periphery of the center housing not at a particular point but on a broad area, which is variable in accordance with the number of vanes and the position of a discharge port. The compression working space is defined by two adjacent vanes to have the maximum pressure immediately before it opens to the discharge port. The maximum pressure suddenly drops when immediately after the compression working space is vent to the discharge port. This is the reason the rotary sleeve makes an irregular motion and touches the compression side inner periphery of the center housing on the aforementioned contact area. Besides, the rotaty sleeve also makes another irregular motion to contact the suction side inner periphery of the center housing whenever the engine speed or rotor speed suddenly changes.

It is the primary object of the invention to provide an improved vane-type rotary compressor in which a rotary sleeve is prevented from contacting the inner periphery of the center housing when it is pushed toward the compression side by compressed air in the compressor and free from irregular motion when the engine speed suddenly changes.

DISCLOSURE OF THE INVENTION

The present invention consists in a vane-type rotary compressor comprising a center housing, a rotary sleeve mounted in the center housing for rotation with a plurality of vanes movable in a rotor which is eccentrically disposed in the rotary sleeve, an air-bearing room defined between the inner periphery of the center housing and the outer periphery of the rotary sleeve, and a pair of discharge and suction chambers, wherein the center housing has the inner periphery thereof formed with at least an inlet port which is internally connected to the atmosphere, the discharge chamber or the compression working space defined between the adjacent vanes whereby the air-bearing room is supplied with air through the inlet port to increase the air-flowing over an area to which the rotary sleeve may contact. The increased air-flowing backs up the air-bearing performance in the air-bearing room to prevent the outer periphery of the rotary sleeve from touching the inner periphery of the center housing. The center housing can have an outlet port formed in the inner periphery thereof and internally connected to the atmosphere and the suction chamber to exhaust the air passed by the area to which the rotary sleeve may contact.

At least a pocket is desirably formed in the inner periphery of the center housing, particularly in the area to which the rotary sleeve may contact. The pocket in the compression side inner periphery is effective to increase the air-bearing performance and protect the compression side inner periphery against direct contact with the outer periphery of the rotary sleeve when the rotary sleeve is displaced to the compression side inner periphery of the center housing by high-pressure air in the compression working space. The pocket in the suction side inner periphery of the center housing also increases the air-bearing performance in the suction side of the air-bearing room to prevent the rotary sleeve from contacting the suction side inner periphery of the center housing when the engine speed suddenly changes to cause the rotor to make an irregular motion. In addition to the pocket as described above, a balancing pocket can be provided at either or both positions oppositely equidistantly apart from a diametrically symmetrical point with respect to a certain position in which the compression working space has the maximum pressure, so that the air-bearing performance is raised in the compression and suction sides of the air-bearing room, thereby the rotary sleeve and the center housing being effectively protected against scuffing and seizure troubles.

BEST MODE FOR CARRYING OUT THE INVENTION

Figure 1:
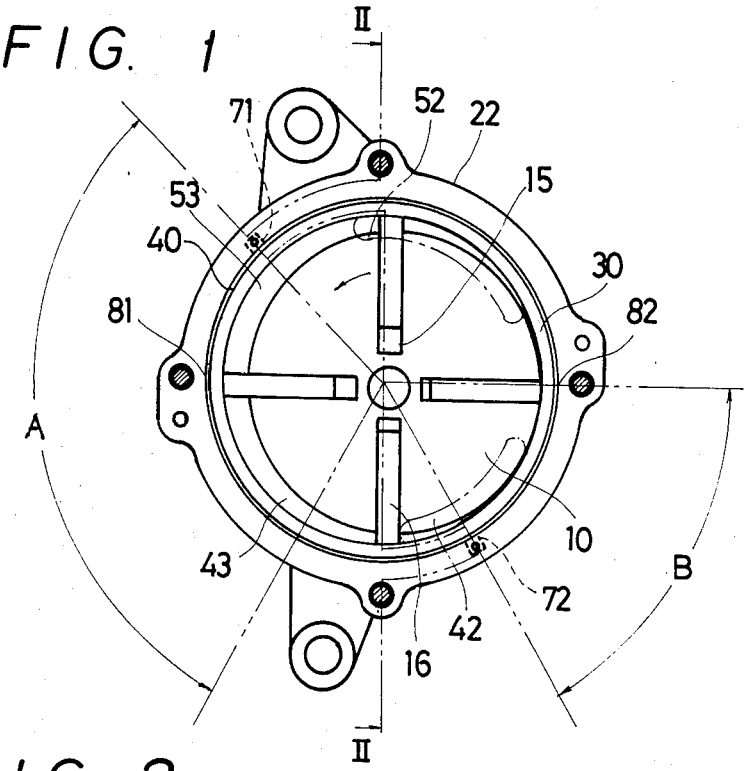
FIG. 1 is a cross-sectional view of the rotary compressor according to the invention, showing the side surface of the rotor by eliminating the rear housing.

The invention will be explained with reference to drawings which illustrate specific embodiments. Referring initially to FIG. 1, the compressor has a center housing 22, a rotary sleeve 30 mounted in the center housing, and a rotor 10 eccentrically disposed in the rotary sleeve. The rotor 10 rotates in the direction as indicated by an arrow and has a plurality of vanes 16 movably fitted in the respective vane grooves 15. Th vane 16 has its apex in contact with the inner periphery of the rotary sleeve 30. The rotary sleeve 30 is floatingly supported in the air-bearing room 40 confined between the inner periphery of the center housing 22 and the outer periphery of the rotary sleeve 30.

Figure 2:
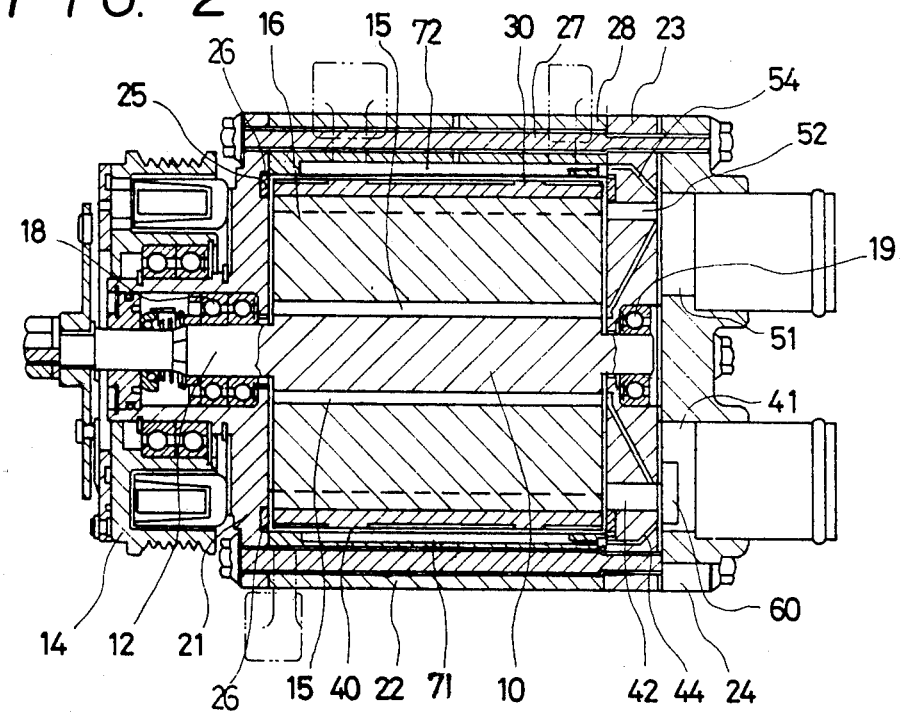
FIG. 2 is a section taken along the line II—II of FIG. 1.

As seen in FIG. 2, the rotor 10 is integrally shaped with a shaft 12 rotatably supported by bearings 18, 19 in the respective front and rear housings 21, 23 and fixed at the front end thereof to a pulley 14 which is a non-illustrated engine. A plurality of vanes are slidably fitted in the vane grooves 15 in the rotor 10 and have the apexes in contact with the rotary sleeve 30, which is mounted within the center housing 22 to define a filmy air-bearing room 40 therebetween. A gasket is interposed between the rear housing 23 and the rear cover 24 in which the discharge chamber 41 and the suction chamber 51 are provided.

The discharge chamber 41 is internally connected to a discharge port 42 through a discharge valve 60 and the suction chamber 51 is internally connected to a suction port 52. The front and rear housings 21, 23 have their inner surfaces formed with annular grooves 26 in which self-lubrication bearing members 25 are embedded for smooth contact with the end surfaces of the rotary sleeve 30. Bolts 27 pass through the thick wall portions 28 of the center housing 22 to axially fasten the front and rear housings 21, 23, the center housing 22 and the rear cover 24. High-pressure and low-pressure bores 44, 54 extend through the rear housing 23 from the discharge and suction ports 42, 52 to the side surface of the center housing 22. A pair of inlet and outlet ports 71, 72 are provided in the periphery of the center housing 22 and internally connected to the respective high-pressure and low-pressure bores 44, 54.

As seen in FIG. 1, the discharge port 42 is internally connected to a compression working space 43 defined by two adjacent vanes 16. The opposite suction port 52 is connected to a suction side working space 53 confined by the adjacent vanes 16. The inlet and outlet ports 71, 72 are desirably disposed on the respective areas A, B in the inner periphery of the center housing 22 as shown in FIG. 1, in order to increase the air-flowing over a range of the stating line of area A to the terminal line of are B, to which the rotary sleeve 30 is most likely to contact. The area A forms a circular arc with a subtended angle of about 105 degrees with respect to the axis of the center housing 22, about 40 degrees toward the suction side about 65 degrees toward the compression side from starting line 81 of the compression side, the area B forming a circular arc with a subtended angle of about 60 degrees toward the compression side from the terminal line 82 of the compression side.

The rotary sleeve 30, during rotating at high speeds, can pump air into the air-bearing room through the inlet port 71 from the atmosphere, so that the inlet port 71 may vent to the atmosphere. The air, after passed by the area to which the rotary sleeve 30 may contact, can enter the suction working space through the side surface of the rotary sleeve 30, so that the outlet port 72 is not always required.

Figure 3:
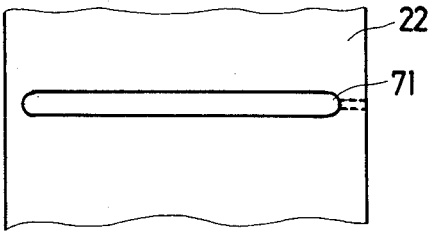
FIGS. 3 to 7 are views of different inlet or outlet ports provided in the inner periphery of the center housing.
Figure 6:
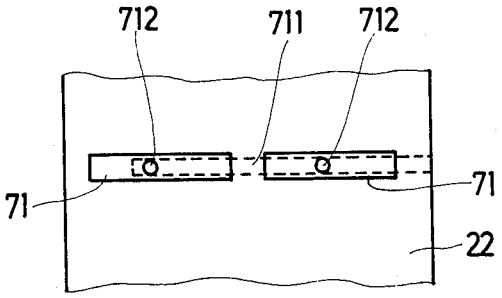
Figure 4:
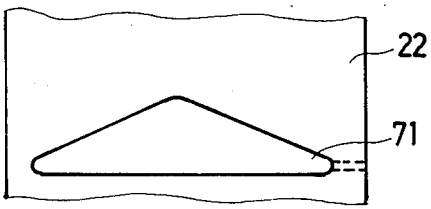
Figure 7:
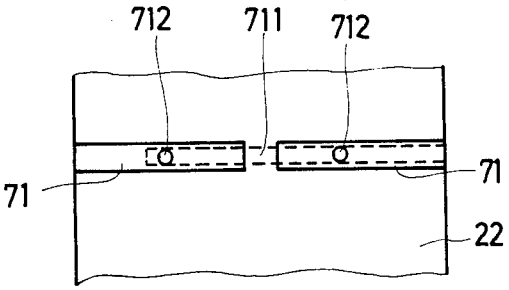
Figure 5:
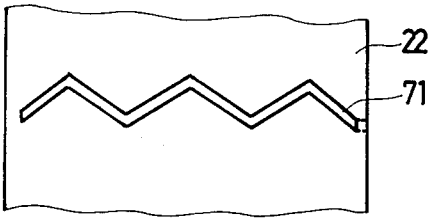

The inlet port 71 as well as the outlet port 72 in the inner periphery of the center housing 22 can be shaped in any form of a narrow rectilinear groove as shown in FIG. 3, an equilateral triangular groove as shown in FIG. 4, a zigzag groove as shown in FIG. 5, and a pair of narrow rectilinear grooves separated by a central land 711 and provided with a plurality of injection bores 712 internally connected to a blind high-pressure hole as shown in FIGS. 6 and 7.

In operation, as engine rotates the rotor 10, air is compressed in the compression working space 43. The compressed air has a force to push the rotary sleeve 30 from within toward the compression side inner periphery of the center housing 22. The force, changing in accordance with the position of moving vanes 16, would cause the rotary sleeve 30 to move along an elliptical line and contact the inner periphery of the center housing 22. However, fresh air is introduced through the inlet port 71 into the air-bearing room 40 to increase the air-flowing over the contact area. The increased air raises the bearing performance in the air-bearing room 40 to prevent the rotary sleeve 30 from contacting the inner periphery of the center housing, thereby the rotary sleeve 30 keeping its floating rotation. The air partly flows off through the outlet port 72.

Figure 8:
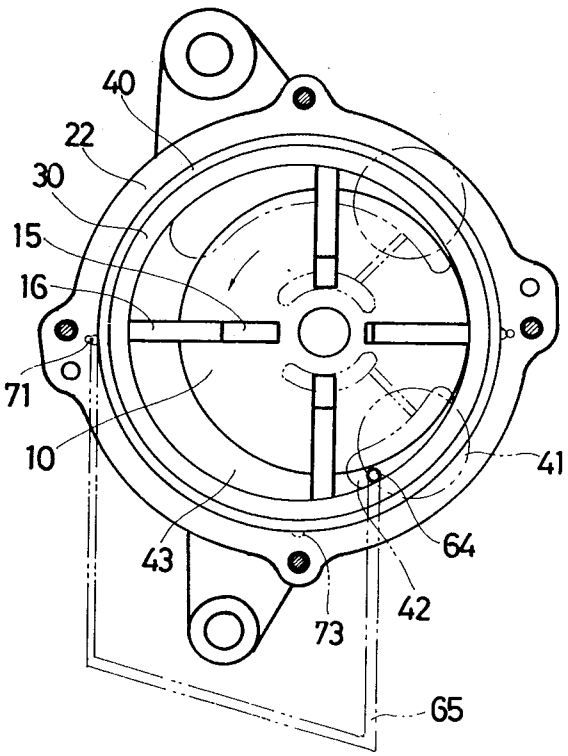
Figure 11:
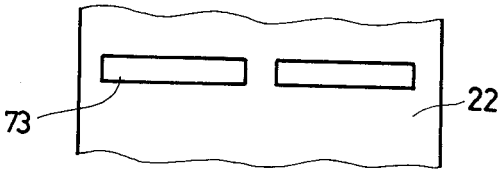
FIGS. 11 to 14 are plan views of different pockets provided in the inner periphery of the center housing.
Figure 13:
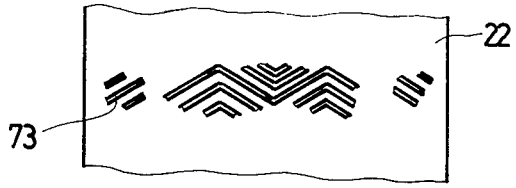
Figure 12:
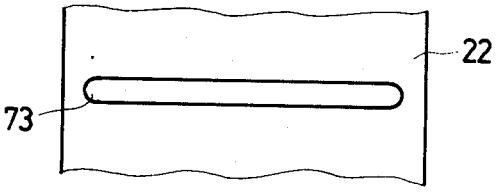
Figure 14:
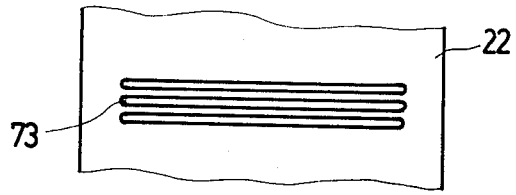

Referring to FIG. 8, in which the rotor 10 rotates in the direction as indicated by an arrow, the vanes 16 project from the respective grooves 15 to contact the inner periphery of the rotary sleeve 30. The rotary sleeve 30 is mounted in the center housing 22 to define an air-bearing room 40, the width of which is exaggeratgedly illustrated but really less than 0.1 mm. The compressed air in the compression working space 43 defined between two vanes 16 has the maximum pressure immediately before vent to the discharge chamber 41 through the discharge port 42. An extraction port 64 is provided in the discharge chamber 41 or in front of the discharge port 42 in which the compression working space 43 has the maximum pressure. The inlet port 71 is provided at the starting line of an area in the compression side inner periphery of the center housing 22 which the rotary sleeve 30 may contact and internally connected to the extraction port 64 through an extraction passage 65, which is illustrated, for easy understanding, as were outside the center housing 22 by dotted lines, but really locates within the center housing. A pocket 73 is provided in the compression side inner periphery of the center housing 22 near the discharge port 42, axially extending to the vicinity of the both side ends of the center housing as seen in FIGS. 11 to 14. The pocket 73 can be shaped in any form of a pair of rectilinear grroves as shown in FIG. 11, a single rectilinear groove as shown in FIG. 12, a group of herringbone grooves as shown in FIG. 13 and a group of narrow linear grooves as shown in FIG. 14.

Figure 9:
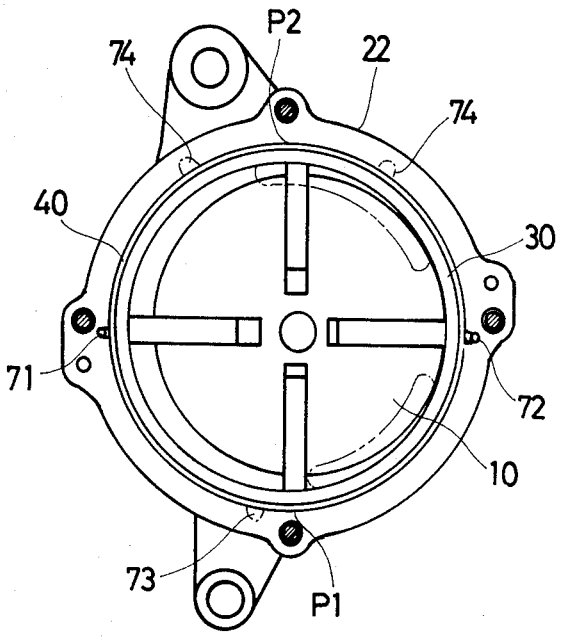

As seen in FIG. 9, a pair of balancing pockets 74 are formed at both positions oppositely, equidistantly apart from a suction side point P2 which is opposite to a compression side point P1 in which the air-bearing room 40 is subject to the maximum pressure. The pocket 74 is the same in shape as shown in FIGS. 11 to 14 and effective to locally increase bearing performance.

The compressor of FIG. 9 has an air-bearing room 40 with a bearing performance raised not only in the compression side by the help of the high-pressure air flowing supplied by the inlet port 71 and pocket 73 but also in the suction side by the use of balancing pocket 74. Thus, the rotary sleeve 30 and the center housing 22 are protected against direct contact or scuffing therebetween. A part of the air passed along the contact area is exhausted to the open air through the outlet port 72.

Figure 10:
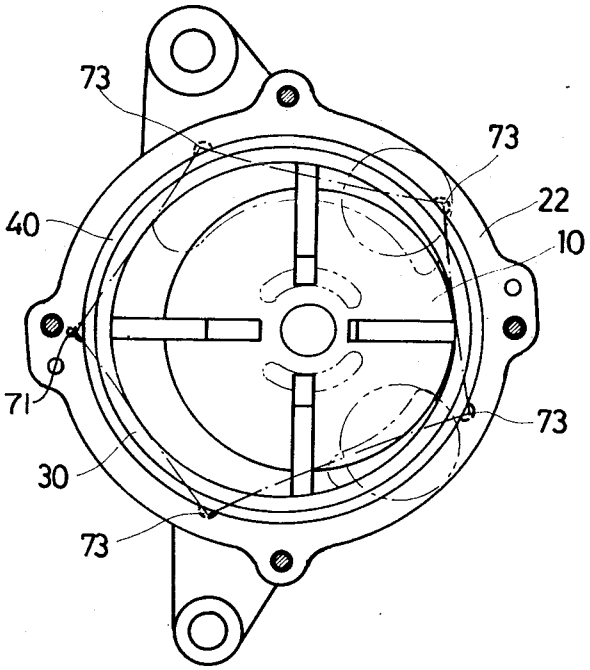
FIGS. 8 to 10 are views of other embodiments, similar to FIG. 1.

As seen in FIG. 10, four pockets 73 are formed in the inner periphery of the center housing 22, two in the compression side and two in the suction side. An inlet port 71 and the four pockets 73 situate at the respective apexes of a pentagon which is coaxial with the center housing 22, as shown by an imaginary line in FIG. 10. Even if the rotary sleeve 30 makes an irregular motion due to a sudden change in the rotational speed of engine or rotor 10, the pockets 73 in the suction side raise the suction side bearing performance of the air-bearing room 40 to prevent the rotary sleeve from contacting the suction side inner periphery of the center housing 22. The pockets 73 in the compression side also raise the compression side bearing performance to prevent the rotary sleeve from touching the compression side inner periphery. The center housing can have the inner periphery thereof partly or fully formed with a plurality of herringbone type air-accumulating grooves for the purpose of increasing the bearing performance of the air-bearing room.

We claim:

1. A vane-type rotary compressor having a sleeve for rotation with vanes comprising a center housing, a rotary sleeve mounted in said center housing for rotation with a plurality of vanes movably fitted in a rotor which is eccentrically disposed in said rotary sleeve, an air-bearing room defined between the outer periphery of said rotary sleeve and the inner periphery of said center housing, an inlet port provided in the inner periphery of said center housing and internally connected to a compression working space defined between two adjacent vanes, and at least a pocket provided in the inner periphery of said center housing, characterized in that said pocket is formed in the suction side inner periphery of said center housing.

2. A vane-type rotary compressor having a sleeve for rotation with vanes comprising a center housing, a rotary sleeve mounted in said center housing for rotation with a plurality of vanes movably fitted in a rotor which is eccentrically disposed in said rotary sleeve, an air-bearing room defined between the outer periphery of said rotary sleeve and the inner periphery of said center housing, an inlet port provided in the inner periphery of said center housing and internally connected to a compression working space defined between two adjacent vanes, and at least a pocket provided in the inner periphery of said center housing, characterized in that said inlet port and four pockets situate at the respective apexes of a pentagon coaxial with said center housing.

3. A vane-type rotary compressor having a sleeve for rotation with vanes comprising a center housing, a rotary sleeve mounted in said center housing for rotation with a plurality of vanes movably fitted in a rotary which is eccentrically disposed in said rotary sleeve, a discharge port, an air-bearing room defined between the outer periphery of said rotary sleeve and the inner periphery of said center housing, said air-bearing room has a compression side point subject to maximum pressure located immediately before said discharge port, an inlet port provided in the inner periphery of said center housing and internally connected to a compression working space defined between two adjacent vanes, at least a pocket provided in the inner periphery of said center housing, and wherein a port of said pockets are provided equidistant from a suction side point whch is diametrically opposite to said compression side point.

4. A vane-type rotary compressor having a sleeve for rotation with vanes comprising a center housing, a rotary sleeve mounted in said center housing for rotation with a plurality of vanes smoothly fitted in a rotor which is eccentrically disposed in said rotary sleeve, an air-bearing room defined between the outer periphery of said rotary sleeve and the inner periphery of said center housing, an inlet port provided in the inner periphery of said center housing and internally connected to a discharge chamber, and at least a pocket provided in the inner periphery of said center housing, characterized in that said pocket is formed in the suction side inner periphery of said center housing.

5. A vane-type rotary compressor having a sleeve for rotation with vanes comprising a center housing, a rotary sleeve mounted in said center housing for rotation with a plurality of vanes movably fitted in a rotor which is eccentrically disposed in said rotary sleeve, an air-bearing room defined between the outer periphery of said rotary sleeve and the inner periphery of said center housing, an inlet port provided in the inner periphery of said center housing and internally connected to a discharge chamber, and at least a pocket provided in the inner periphery of said center housing, characterized in that said inlet port and four pockets situate at the respective apexes of a pentagon coaxial with said center housing.

6. A vane-type rotary compressor having a sleeve for rotation with vanes comprising a center housing, a rotary sleeve mounted in said center housing for rotation with a plurality of vanes movably fitted in a rotor which is eccentrically disposed in said rotary sleeve, a discharge port, an air-bearing room defined between the outer periphery of said rotary sleeve and the inner periphery of said center housing, said air-bearing room has a compression side point subject to maximum pressure located immediately before said discharge port, an inlet port provided in the inner periphery of said center housing and internally connected to a discharge chamber, at least a pocket provided in the inner periphery of said center housing, and wherein a pair of said pockets are provided at positions equidistant from a suction side point which is diametrically opposite to said compression side point.

7. A vane-type rotary compressor having a sleeve for rotation with vanes comprising a center housing, a rotary sleeve mounted in said center housing for rotation with a plurality of vanes movably fitted in a rotor which is eccentrically disposed in said rotary sleeve, an air-bearing room defined between the outer periphery of said rotary sleeve and the inner periphery of said center housing, an inlet port provided in the inner periphery of said center housing and internally connected to the atmosphere, and at least a pocket provided in the inner periphery of said center housing, characterized in that said pocket is formed in the suction side inner periphery of said center housing.

8. A vane-type rotary compressor having a sleeve for rotation with vanes comprising a center housing, a rotary sleeve mounted in said center housing for rotation with a plurality of vanes movably fitted in a rotor which is eccentrically disposed in said rotary sleeve, an air-bearing room defined between the outer periphery of said rotary sleeve and the inner periphery of said center housing, an inlet port provided in the inner periphery of said center housing and internally connected to the atmosphere, and at least a pocket provided in the inner periphery of said center housing, characterized in that said inlet port and four pockets situate at the respective apexes of a pentagon coaxial with said center housing.

9. A vane-type rotary compressor having a sleeve for rotation with vanes comprising a center housing, a rotary sleeve mounted in said center housing for rotation with a plurality of vanes movably fitted in a rotor which is eccentrically disposed in said rotary sleeve, an air-bearing room defined between the outer periphery of said rotary sleeve and the inner periphery of said center housing, said air-bearing room has a compression side point subject to maximum pressure immediately before said discharge port, an inlet port provided in the inner periphery of said center housing and internally connected to the atmosphere, at least a pocket provided in the inner periphery of said center housing, and wherein a pair of said pockets are provided at positions equidistant from a suction side point which is diametrically opposite to said compression side point.

* * * * *